United States Patent [19]

Sasame et al.

[11] 3,941,569

[45] Mar. 2, 1976

[54] METHOD FOR MAKING FERROUS METAL HAVING IMPROVED RESISTANCES TO CORROSION AT ELEVATED TEMPERATURES AND TO OXIDIZATION

[75] Inventors: Takao Sasame; Toshio Yagi, both of Hiroshima, Japan

[73] Assignee: Toyo Kogyo Co., Ltd., Hiroshima, Japan

[22] Filed: June 6, 1974

[21] Appl. No.: 477,164

Related U.S. Application Data

[62] Division of Ser. No. 305,558, Nov. 10, 1972.

[52] U.S. Cl. ..... 29/183.5; 29/196.2; 427/383; 427/431; 148/6.3

[51] Int. Cl.[2] ..... C23C 1/08; C23C 9/00

[58] Field of Search..... 117/114 C, 130 R; 427/320, 427/383, 431, 432; 29/196.2, 183.5

[56] References Cited

UNITED STATES PATENTS

| | | | |
|---|---|---|---|
| 1,409,017 | 3/1922 | Ortiz | 427/431 X |
| 2,197,622 | 4/1940 | Sendzimir | 117/114 C |
| 2,625,495 | 11/1953 | Cone et al. | 117/114 C |
| 2,824,020 | 2/1958 | Cook et al. | 117/114 C |
| 2,917,818 | 12/1959 | Thompson | 29/196.2 X |
| 2,955,958 | 10/1960 | Brown | 117/114 C |
| 3,027,269 | 3/1962 | Teshima et al. | 117/114 C |
| 3,287,159 | 11/1966 | Bellis et al. | 29/196.2 X |
| 3,467,545 | 9/1969 | Carter | 29/196.2 X |
| 3,567,409 | 3/1971 | Seiler | 29/196.2 X |

FOREIGN PATENTS OR APPLICATIONS

| | | |
|---|---|---|
| 1,391,659 | 2/1965 | France |
| 983,726 | 2/1951 | France |
| 714,928 | 9/1931 | France |
| 709,247 | 8/1941 | Germany |

OTHER PUBLICATIONS

Stahl und Eisen, Vol. 77, No. 7, 1957, pp. 435–438.
Werkstattstechnik, Bulletin 1, 1961, pp. 23–29.
Sharp, SAE Journal, Oct. 66, pp. 66–69, Vol. 74, No. 10.

*Primary Examiner*—Ralph S. Kendall
*Attorney, Agent, or Firm*—Wenderoth, Lind & Ponack

[57] ABSTRACT

A method for making ferrous metal having highly improved resistances to corrosion and to oxidization, which comprises hot-dipping a metallic workpiece in a molten aluminum or aluminum alloy bath, primary heat-treatment of the metallic workpiece and secondary heat-treatment of the metallic workpiece. During the primary heat-treatment, an intermetallic compound layer is formed over the surface of the metallic workpiece, which is developed into an alloy layer during the secondary heat-treatment to make the alloy layer firmly secured to the base of the workpiece. The secondary heat-treatment may be omitted depending on the application of the ferrous metal processed by this method.

4 Claims, 4 Drawing Figures

Figure 1:
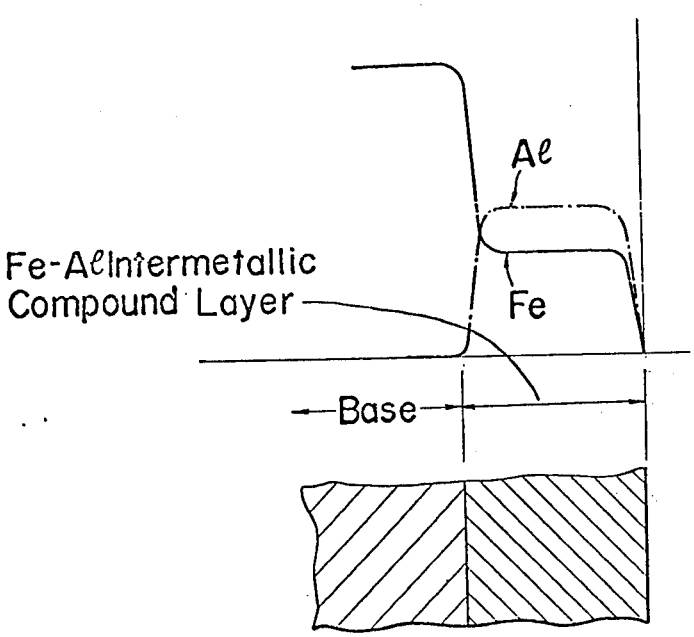

METHOD FOR MAKING FERROUS METAL HAVING IMPROVED RESISTANCES TO CORROSION AT ELEVATED TEMPERATURES AND TO OXIDIZATION

This is a division of application Ser. No. 305,558, filed Nov. 10, 1972.

The present invention relates to a method for making ferrous metal having highly improved resistances to corrosion at elevated temperatures and to oxidization and, more particularly, to the method wherein a ferrous metal workpiece, after having been hot-dipped in a molten metal bath containing therein aluminum or its alloy with chromium, is heat-treated to form an alloy layer on the base of the ferrous metal workpiece thereby to improve the resistances to corrosion at elevated temperatures and to oxidization.

In the automobile industry, an after-burner or thermal reactor has been largely employed in an automotive vehicle and it has been well recognized as one of effective means for reducing or substantially eliminating noxious unburned compounds present in exhaust gas emerging from the exhaust system of the automotive vehicle. As has been well understood, the exhaust gas emerging from the automotive exhaust system contains, in addition to the unburned compounds such as CO and HC, gaseous halogens and halides and/or lead compounds such as $Cl_2$, $Br_2$, $PbCl_2$, $PbBr_2$, $C_2H_2Cl_2$and $C_2H_2Br_2$, which are corrosive mediums. In the presence of such corrosive mediums, various metallic parts disposed in the automotive exhaust system tend to be easily corroded and, in the case where such an after-burner is provided in the automotive exhaust system, in which the interior temperature tends to elevate up to 900°C. and, in an extreme case, up to 1,200°C., during re-combustion of the unburned compounds in said after-burner, corrosion of the after-burner is accelerated by the elevated temperature, thus reducing the working efficiency of the after-burner while shortening the service time of the after-burner. In view of this, especially the after-burner is required to be made of specially designed, expensive material having sufficient resistances to corrosion at the elevated temperatures as well as to oxidization.

Recently, such a metallic material as having a relatively high corrosion resistance at elevated temperatures as well as a sufficient resistance to oxidization has been developed in the field of space craft industry, which may be more or less satisfactorily employed in the manufacture of the after-burner or thermal reactor. However, this metallic material developed for the manufacture of a space craft is too expensive to make it available for the manufacture of metallic articles for public use including an automotive vehicle having such an after-burner.

Accordingly, and essential object of the present invention is to provide an improved method for making ferrous metal having a relatively high corrosion resistance and resistance to oxidization which can be relatively easily manufactured at low costs.

Another important object of the present invention is to provide the improved method of the above mentioned character wherein an article made of ferrous metal is first hot-dipped in a molten metal bath containing therein aluminum or its alloy to form an aluminum foil over the surface of said article and, then, subjected to a heat-treatment to form an alloy layer on the base of the ferrous metal of said article thereby to improve the corrosion and oxidization resistances of said article, without requiring a substantially complicated procedure.

It is a related object of the present invention to provide a ferrous metal workpiece manufactured by the above mentioned method.

It is to be noted that the present invention has been primarily developed in view of providing a relatively high corrosion and oxidization resistant and inexpensive metallic material for the manufacture of the after-burner. However, the method of the present invention has many applications and, for example, it is applicable not only to the manufacture of automotive vehicle parts such as after-burner and exhaust muffler, but also to the manufacture of various metallic articles such as plates, pipings, containers, vessels and others, all of which are accessible to corrosive mediums in gaseous, solid or liquid state and which are made of ferrous metal.

Furthermore, in view of the fact that the ferrous metal processed by the method of the present invention has a relatively high corrosion resistance as well as a relatively high resistance to oxidization, the method of the present invention can be applicable to the manufacture of various articles which require either or both of these characteristics. Moreover, the corrosion resistance of the ferrous metal processed by the method of the present invention permits such ferrous metal to be used in the manufacture of various jigs for use in casting of light alloys such as those of aluminum and zinc, which may otherwise be easily oxidized in contact with the molten casting metal.

It is also to be noted that the present invention may be applicable to any type of metallic articles including unprocessed workpieces produced by such methods as rolling, extrusion, drawing, casting and others and intermediate and final products processed by such methods as pressing, welding, grinding and others. In addition thereto, the unprocessed, intermediate or final products, after having been processed by the method of the present invention, may be electro-plated in any suitable manner.

Figure 2:
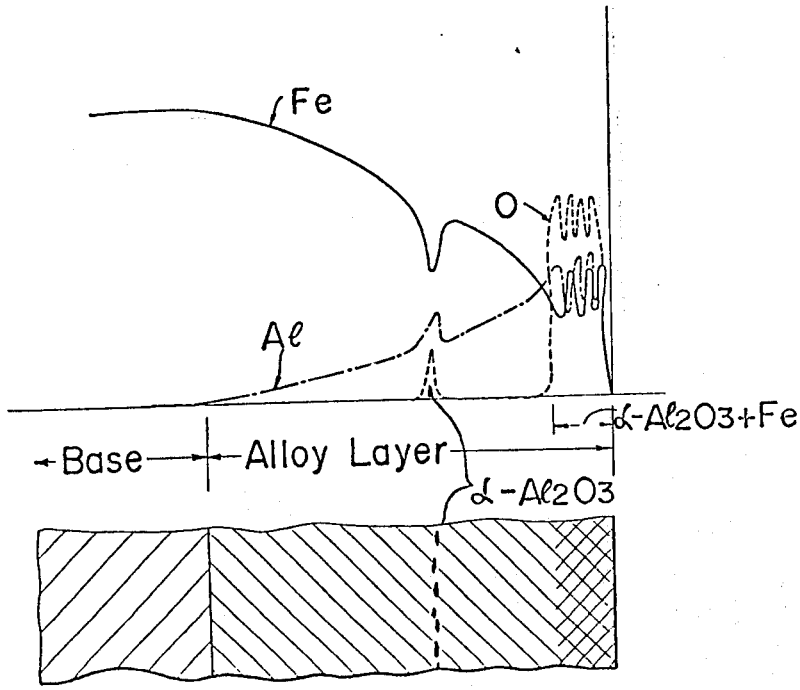
Figure 3:
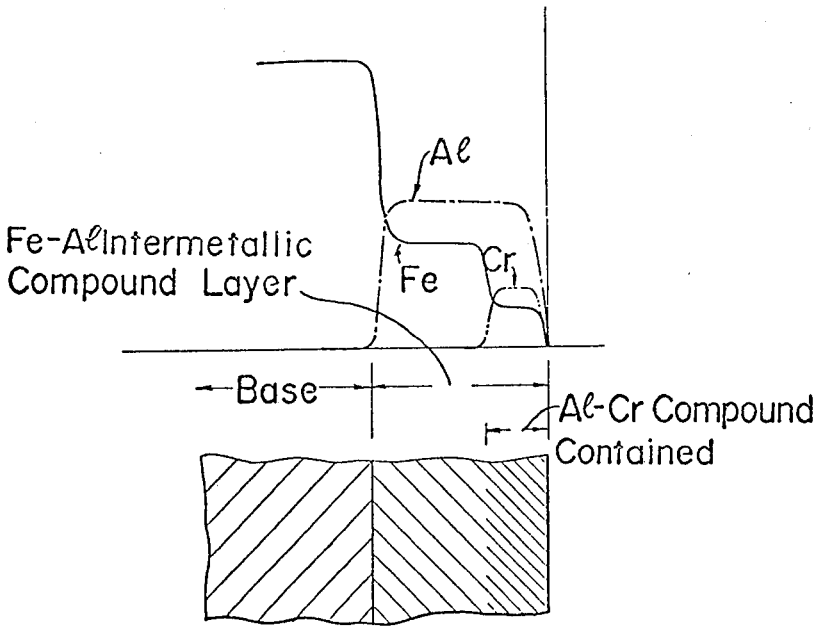
Figure 4:
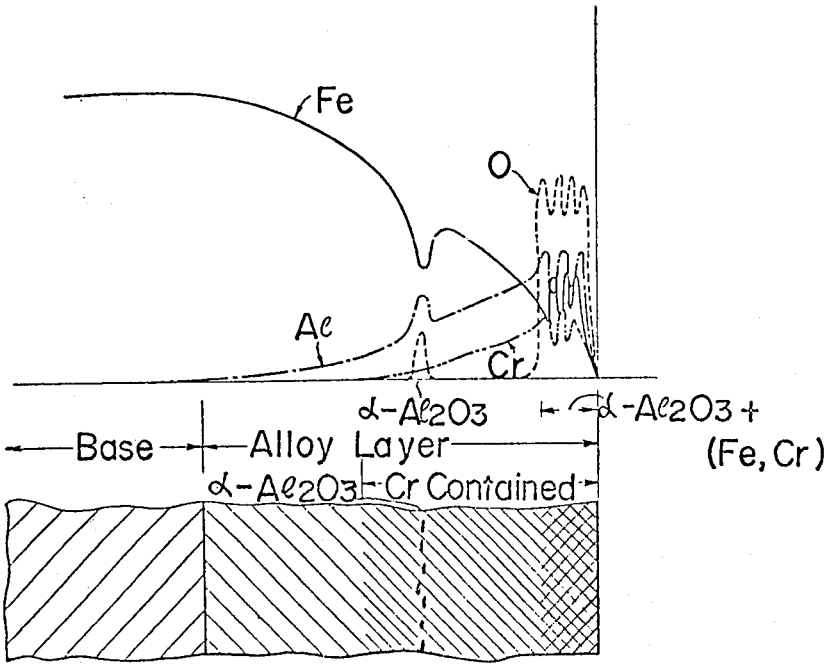

These and other objects and features of the present invention will become apparent from the following description taken in conjunction with a preferred embodiment thereof with reference to the accompanying drawings, in which;

FIG. 1 is a schematic diagram showing the longitudinal section of a ferrous workpiece obtained by dipping in a molten metal bath containing substantially pure aluminum and then heat-treating according to the present invention and a graph obtained by the X-ray microanalizer of distribution of various elements contained in the ferrous workpiece thus processed, FIG. 2 is a diagram similar to FIG. 1, but the ferrous workpiece being further heat-treated, FIG. 3 is a schematic diagram showing the longitudinal section of another ferrous workpiece obtained by dipping in a molten metal bath containing an aluminum alloy including 4 wt% of chromium and then heat-treating according to the present invention and a graph obtained by the X-ray microanalizer of distribution of various elements contained in the ferrous workpiece thus processed, and FIG. 4 is a diagram similar to FIG. 3, but the ferrous workpiece being further heat-treated.

Before the description of the present invention proceeds, it is to be noted that, although various elements contained in an article made of ferrous metal (hereinafter referred to as ferrous workpiece), for example, Cr and Ni in the case where such ferrous workpiece is made of austenitic stainless steel, are in practice distributed in a layer formed on the surface of said workpiece during execution of the method of the present invention, more or less affecting the characteristics of said layer, the distribution of such elements is not shown in the accompanying drawings because the present invention is to be understood in terms of a relationship between a ferrous substance contained in the workpiece and an aluminum substance and/or a chromium substance contained in the layer.

It is further to be noted that the method of the present invention can be applicable to any workpiece made of any one of ferrous steels, including various carbon steels and such special steels as ferritic stainless steel, martensitic stainless steel and austenitic stainless steel, and cast irons including ordinary cast irons and such special cast irons as ductile cast iron and alloy cast iron. In other words, it is to be understood that any workpiece made of material having Fe as the principle component can be subjected to the method of the present invention even if it contains, in addition to Fe, one or a mixture of numerous inorganic additives.

As the first step of execution of the method of the present invention, the ferrous workpiece is hot-dipped for 30 to 300 seconds in a molten metal bath containing therein aluminum or its alloy and heated to a temperature of from 700° to 950°C., thereby to form a metallic foil on the surface thereof. The reason for the employment of aluminum or its alloy for the molten metal bath is because of its excellent corrosion and oxidization resistances.

In this case, if the bath temperature is lower then the lowermost limit of 700°C., a staisfactory result cannot be obtained and, if it is higher than the uppermost limit of 950°C., dimensional variation of the ferrous workpiece will be observable due to softening of the ferrous workpiece under the elevated temperature and, in an extreme case, it will be partially or wholly melted into the molten metal bath.

Preferably, the use of aluminum alloy is recommended for the molten metal bath, in which case the aluminum alloy must contain chromium in an amount within the range of from 1 to 10 percent by weight based on the total weight of the aluminum alloy. This is because the presence of chromium in the molten metal bath results in an improvement in the smoothness of the surface of the resultant foil adhering to the ferrous workpiece and also in the corrosion resistance with respect to any of lead compounds. However, if the aluminum alloy including chromium in an amount smaller than the lowermost limit of 1 wt% is employed, such improvements are hereinabove described cannot be obtained whereas, if the alloy including chromium in an amount greater than the uppermost limit of 10 wt% is employed, the surface of a compound layer as will be mentioned later will be roughened at the time of completion of the subsequent heat-treatment. It is to be noted that, in the case where the molten metal bath is prepared by the use of the aluminum alloy including chromium in the specified amount, the lowermost limit of the bath temperature be preferably fixed at 750°C.

With the above in mind, if the dipping time is shorter than the lowermost limit of 30 seconds, the subsequent heat-treatment of the ferrous workpiece having the metalllic foil thereon will not result in satisfactory formation of the compound layer, that is, an Al-Fe intermetallic compound layer containing a Fe-Al comound, such as $Fe_2Al_5$and $Fe_2Al_3$ , as the principle component in a desired depth, whereas, if it is longer than the uppermost limit of 300 seconds, a ferrous substance contained in the ferrous workpiece will be melted into the molten bath, thus reducing the weight of the workpiece to be processed. The dipping time may vary, within the range of 30 to 300 seconds, depending upon the thickness and shape of the ferrous workpiece to be processed by the method of the present invention.

Subsequent to the hot-dipping process, the ferrous workpiece having the metallic foil thereon is then subjected to a primary heat-treatment thereby to cause the aluminum substance in the metallic foil to undergo an intermetallic combination with the ferrous substance in the ferrous workpiece. More specifically, if the substantially pure aluminum is employed for the molten metal bath, only the Fe-Al intermetallic compound layer of 50 to 200 microns in depth which contains the Fe-Al compound as the principle component can be obtained as shown in FIG. 1. On the other hand, if the aluminum alloy is employed for the molten metal bath, as shown in FIG. 3, not only the Fe-Al intermetallic compound layer of 50 to 200 microns in depth can be obtained, but also the same intermetallic compound layer contains, in addition to the Fe-Al compound as the principle component, an Al-Cr compound, such as $Al_2Cr$ and $Al_5$ Cr, distributed substantially in the vicinity of the surface of said intermetallic compound layer with the aluminum substance being stablized therein.

To achieve the optimum result, the primary heat-treatment must be carried out under a temperature of from 700° to 930°C. for more than 30 minutes. If the heating temperature is lower than the lowermost limit of 700°C., the intermetallic compound layer will not satisfactorily obtained and, if it is higher than the uppermost limit of 930°C., the aluminum substance contained in the foil will not satisfactorily undergo the intermetallic combination with the ferrous substance in the ferrous workpiece during this primary heat treatment and, hence, a satisfactory development of the intermetallic compound layer will not be observable, because of being oxidized into $Al_2O_3$ without providing the desired corrosion resistance. The heating temperature may vary, within the range of from 700° to 950°C., depending upon the type or kind of the ferrous workpiece to be processed by the method of the present invention.

In addition, the heating time must be not less than 30 minutes, or otherwise development of the intermetallic compound layer will not be satisfactorily observed. However, the heating may preferably continue for not more than 3 hours in view of economical industrial practice.

This primary heat-treatment may be carried out in any ambient atmosphere except for an extremely oxidizing atmosphere.

The art of hot-dipping a ferrous workpiece in the molten metal bath containing aluminum or its alloy for the purpose of improving the resistance to oxidization is heretofore known by those skilled in the art. However, the fact has not yet been known that the resistance to corrosion at the elevated temperature of the ferrous workpiece after having been dipped in the molten metal bath can be improved by heat-treatment under the temperature of from 700° to 930°C. for more than 30 minutes. In other words, because a ferrous article manufactured merely by dipping it in the molten metal bath is such that the aluminum substance contained in the resultant foil is not distributed so as to combine with the ferrous substance, the article lacks the sufficient corrosion resistance. From the foregoing, it is clear that the most important feature of the present invention so far described resides in that the ferrous workpiece is, after having been hot-dipped in the molten metal bath, subjected to the heat-treatment under the particular temperature of the particular period of time.

It is also clear that the aluminum substance transplanted to the surface of the ferrous workpiece during the hot-dipping process is uniformly distributed into the workpiece during the primary heat-treatment to provide the intermetallic compound layer which has relatively high corrosion and oxidization resistances. However, this intermetallic compound layer has a somewhat insufficient interlocking with respect to the base of the ferrous workpiece.

Accordingly, in the case where the ferrous workpiece having the intermetallic compound layer is to be used in contact with flowing particles of gaseous corrosive medium and/or to be used in the manufacture of an article accessible to vibrations, it is recommended to carry out a secondary heat-treatment to permit the intermetallic compound layer to be firmly interlocked with the base of the workpiece, i.e., to develop into an alloy layer, without substantially reducing the improved corrosion and oxidization resistances.

This secondary heat-treatment is carried out at a temperature lower than the melting point of the ferrous workpiece and within the range of 950° to 1,350°C. for not more than 10 hours. The primary purpose of this secondary heat-treatment is to diffuse aluminum, which is one of the substances contained in the intermetallic compound layer, into the ferrous workpiece thereby to form the alloy layer having Fe and Al as its principle composition which is firmly interlocked with the base of the ferrous workpiece. During this process, there is a tendency that, as diffusion of aluminum proceeds, the content of aluminum in the surface portion of the resultant alloy layer is reduced with the result of reduction of the corrosion resistance. In order to avoid this tendency, the secondary heat-treatment must be carried out in an oxidizing atmosphere.

If the secondary heat-treatment is carried out in the oxidizing atmosphere as hereinbefore described, the aluminum present in the surface portion of the resultant alloy layer is combined with oxide present in the acidic atmosphere thereby to form a compound such as $\alpha$-$Al_2O_3$ without reducing the density of aluminum present in said surface portion. In addition thereto, in view of the fact that the primary heat-treatment is effective to form the Fe-Al intermetallic compound layer, Fe acts as a binder, even if the aluminum present in said surface portion is oxidized as hereinbefore described, so that a layer of $\alpha$-$Al_2O_3$ compound can be firmly secured in the resultant alloy layer. Accordingly, the improved corrosion and oxidization resistances obtainable by the method of the present invention and not substantially reduced. It is to be noted that, in the case where the molten metal bath contains the aluminum alloy including chromium, chromium also acts as a binder in the surface portion of the resultant alloy layer in cooperation with Fe.

To achieve the optimum result of the secondary heat-treatment, the heating temperature must be within the range of from 950° to 1,350°C. as stated above. If this temperature is lower than the lowermost limit of 950°C. satisfactory diffusion of the aluminum will not be observable and, hence, the alloy layer containing Fe and Al as its principle components will not be satisfactorily formed, resulting in no substantial improvement of the interlocking with the base of the ferrous workpiece. On the other hand, if the temperature is higher than the uppermost limit of 1,350°C., not only the aluminum present in the surface portion of the resultant alloy layer is oxidized into $\alpha$-$Al_2O_3$, but also Fe, which acts as a binder, is oxidized and, therefore, the corrosion resistance and the resistance to oxidization will be reduced. In any event, this heating temperature may vary, within the range of from 950° to 1,350°C., depending upon the melting point of the ferrous workpiece to be processed. In other words, the heating temperature must be lower than the melting point of the workpiece to be processed. For example, in the case where the ferrous workpiece is made of cast iron, it must be lower than 1,100°C.

In addition thereto, the heating time must be not more than 10 hours, or otherwise Al and Fe are similarly oxidized, respectively, with substantial reduction of the corrosion resistance as well as the resistance to oxidization. The minimum permissible heating time during the secondary heat-treatment is not limited because of the fact that the ferrous workpiece that has been subjected to the step of primary heat-treatment can be placed in practical use without subjecting to the secondary heat-treatment. However, in the case where the secondary heat-treatment in the manner as hereinbefore described is to be carried out, at least 30 minutes or more is required. It seems, from the foregoing, that the heating time is limited within the range of 30 minutes to 10 hours and this is true in the case where the secondary heat-treatment is carried out in the usual atmosphere. However, in the case where the secondary heat-treatment is carried out in the oxidizing atmosphere, the heating time may be shorter than the minimum permissible value of 30 minutes.

The alloy layer thus obtained on the ferrous workpiece upon completion of the secondary heat-treatment represents such structures as shown in FIGS. 2 and 4, each of which extends toward the base in a depth of from 200 to 500 microns, the structure of FIG. 2 being the case where the ferrous workpiece has been dipped in the molten metal bath of substantially pure aluminum while the structure of FIG. 4 represents the case where the ferrous workpiece has been dipped in the molten metal bath of the aluminum alloy with chromium.

From FIG. 2, it is clear that the alloy layer contains $\alpha$-$Al_2O_3$ rigidly secured by the binding action of Fe in the vicinity of the surface portion thereof with the aluminum content reducing toward the base. The structure of FIG. 4 is similar to that of FIG. 2, but the $\alpha$-$Al_2O_3$ compound is rigidly secured by the binding action of Fe and Cr while the contents of Al and Cr respectively reduce toward the base. More particularly, in the structure of FIG. 4, the alloy layer comprises a surface portion containing Fe, Al and Cr and a portion adjacent to the base containing Fe and Al.

In either of the structures of FIGS. 2 and 4, the depth of the surface portion of the alloy layer including the $\alpha$-$Al_2O_3$ is approximately 10 to 80 microns.

From the foregoing, it has now become clear that, by the secondary heat-treatment, $\alpha$-$Al_2O_3$ is formed in the surface portion of the alloy layer as workpiece thereby increasing the depth of the resultant alloy layer the binding action of Fe and, consequently, the improved corrosion and oxidization resistances can be obtained. In the case where the alloy layer contains chromium because of the use of the aluminum alloy for the molten metal bath, not only does this chromium cooperate with Fe as a binder, but also the presence of chromium improves the corrosion resistance to the lead compounds and, accordingly, this ferrous material having the alloy layer containing chromium can be advantageously utilized in the manufacture of the after-burner and exhaust muffler. Furthermore, the secondary heat-treatment permits aluminum to diffuse into the ferrous alloy layer with the aluminum content reducing toward the base so that a rigid interlocking can be available.

In the foregoing description, although the presence of the various additives contained in the ferrous workpiece has been neglected, it is to be understood that, if the ferrous workpiece contains the additives, these are also diffused into the alloy layer during the secondary heat-treatment, thereby permitting the alloy layer containing, in addition to Fe and Al as its principle components, such elements as used as are the additives. Accordingly, no substantial reduction of the corrosion and oxidization resistances occur even in the presence of the additives in the ferrous workpiece. By way of example, in the case where the ferrous workpiece is made of austentic stainless steel, chromium and nickel contained in said austentic stainless steel are diffused into the alloy layer during the secondary heat-treatment, thereby forming the alloy layer containing such elements in addition to Fe and Al.

In each of the structures of FIGS. 2 and 4, it is indicated that formation of $\alpha$-$Al_2O_3$ is observable at a substantially intermediate portion of the resultant alloy layer during the secondary heat-treatment. If this formation of $\alpha$-$Al_2O_3$ takes place in a relatively great amount and in the form of a layer, the resultant alloy layer will be peeled off during the layer of $\alpha$-$Al_2O_3$. Accordingly, formation of $\alpha$-$Al_2O_3$ in the form of a layer should be, if possible, avoided. However, it has been found impossible to avoid the formation of $\alpha$-$Al_2O_3$ due to the fact that the secondary heat-treatment is carried out in the acidic atmosphere as hereinbefore described.

According to the present invention, it has been found that, if the secondary heat-treatment is carried out subsequent to the primary heat-treatment which has been carried out under the temperature within the range of 700° to 930°C. for more than 30 minutes thereby to permit the aluminum to be stabilized, formation of $\alpha$-$Al_2O_3$ takes place in an individually scattered manner and, consequently, no substantial peeling of the alloy layer is hereinbefore described takes place.

Hereinafter, the present invention will be illustrated by way of example.

Five groups of four sample pieces A, B, C and D were tested. These four sample pieces A, B, C and D are made of ductile cast iron (globular graphite cast iron), low carbon steel containing 0.1% of carbon, 17Cr steel (a ferritic stainless stee) and 18Cr-8Ni steel (an austenitic stainless steel). It is to be noted that 17Cr steel is specified by "SUS 24" according to the Japanese Industrial Standard G 4304–9 which is an equivalent of 17Cr steel as specified by "Type No. 430" according to the American Iron and Steel Institute or "X8 Cr17" as specified by "No. 4016" according to Deutsche Industrie Normung, and 18Cr–8Ni steel is specified by "SUS 27" according to the Japanese Industrial Standard G 4303–9 which is an equivalent of "18-8S" as specified by "Type No. 304" according to the American Iron and Steel Institute or "X5 CrNi 18 9" as specified by "No. 4301" according to Deutsche Industrie Normung.

The test resuts are shown in the following Table wherein the five groups are classified by I, II, III, IV and V. Of them, the four sample pieces A, B, C and D under Group I were submitted to the test without being processed by the method of present invention while those under Groups II to V were processed by the method of the present invention as exemplified in the Table prior to the test.

Table

| Groups | Sample Piece Codes | Dipping Process: Bath Temp. (°C) | Dipping Process: Type of Molten Metal | Primary Heat-Treatment under Atmosphere: Temp.(°C.) | Primary Heat-Treatment under Atmosphere: Hour | Secondary Heat-Treatment under Atmosphere: Temp.(°C.) | Secondary Heat-Treatment under Atmosphere: Hour | Weight Reduction Rate (%) at 900°C. | Weight Reduction Rate (%) at 1,000°C. | Weight Reduction Rate (%) at 1,100°C. |
|---|---|---|---|---|---|---|---|---|---|---|
| I | A | Not Processed | | Not Treated | | Not Treated | | 32 | 60 | — |
| | B | | | | | | | 25 | 50 | — |
| | C | | | | | | | 15 | 24 | 78 |
| | D | | | | | | | 13 | 21 | 58 |
| II | A | 750 | Pure aluminum dipped | 800 | 1 | Not Treated | | 3 | 8 | — |
| | B | 750 | Pure aluminum dipped | 800 | 1 | Not Treated | | 2 | 6 | — |
| | C | 750 | Pure aluminum dipped | 780 | 1.5 | Not Treated | | 1 | 4 | 13 |
| | D | 750 | Pure aluminum dipped | 770 | 1.5 | Not Treated | | 0 | 3 | 6 |
| III | A | 750 | Pure aluminum dipped | 800 | 1 | 1,100 | 1.5 | 5 | 13 | — |
| | B | 750 | Pure aluminum dipped | 800 | 1 | 1,100 | 2 | 3 | 11 | — |
| | C | 750 | Pure aluminum dipped | 780 | 1.5 | 1,100 | 2 | 2 | 6 | 17 |
| | D | 750 | Pure aluminum dipped | 770 | 1.5 | 1,150 | 1 | 1 | 5 | 7 |
| IV | A | 830 | aluminum alloy with 4% chromium dipped | 800 | 1 | Not Treated | | 0 | 3 | — |
| | B | 830 | aluminum alloy with 4% chromium dipped | 800 | 1 | Not Treated | | 0 | 2 | — |
| | C | 830 | aluminum alloy with 4% chromium dipped | 780 | 1.5 | Not Treated | | 0 | 0 | 1 |
| | D | 830 | aluminum alloy with 4% chromium dipped | 770 | 1.5 | Not Treated | | 0 | 0 | 2 |
| V | A | 830 | aluminum alloy with 4% chromium dipped | 800 | 1 | 1,100 | 1.5 | 0 | 5 | — |
| | B | 830 | aluminum alloy with 4% chromium dipped | 800 | 1 | 1,100 | 2 | 0 | 4 | — |
| | C | 830 | aluminum alloy with 4% chromium dipped | 780 | 1.5 | 1,100 | 2 | 0 | 0 | 2 |
| | D | 830 | aluminum alloy with 4% chromium dipped | 770 | 1.5 | 1,150 | 1 | 0 | 0 | 2 |

The tests were carried out in the following manner: Each sample piece under Groups I to V was prepared in the form of a plate of 3 mm in thickness, 30 mm in width and 20 mm in depth and was horizontally placed on a test bench. A powder of lead halide was spread 2 mm in depth over the upper surface of each of the sample pieces under Groups I to V and heated at a predetermined temperature of 900°C., 1,000°C. and 1,100°C. for 2 hours. Each of the test results is tabulated in the Table in terms of percentage of reduction of the weight with respect to the original weight measured prior to the test.

As to the bondability of the alloy layer in the sample pieces A, B, C and D under Groups II to V, these sample pieces under these Groups were examined in such a manner that a mass of glass particles, approximately 200 microns in particle size, was blasted on to the surface of each of the sample pieces under an air pressure of 5 kg/cm$^2$ for 20 seconds.

Observation of the surface condition of each of the sample pieces under Groups II to V indicated that surface exfoliation in the sample pieces under Groups III and V was less considerable than in the sample pieces under Groups II and IV. This fact clearly indicates that the bondability of the alloy layer with respect to the ferrous workpiece can be improved by performing the secondary heat-treatment, irrespective of the presence of chromium in the molten metal bath during the hot-dipping process.

From the foregoing description, it has now become clear that the presence of chromium in the aluminum bath, i.e., in the case of either the employment of pure aluminum or the aluminum alloy for the molten metal bath, affects the improvement in the corrosion resistance and the resistance to oxidization whereas the presence of the secondary heat-treatment in the method of the present invention improves the bondability of the alloy layer to the ferrous workpiece as compared to that without the secondary heat-treatment.

In any case, the test results exhibit that the method of the present invention is very effective to improve the corrosion and oxidization resistances of the ferrous workpiece as compared with those not processed by the method of the present invention.

Specifically, ferrous metallic material that has been dipped in the molten metal bath of the aluminum alloy, then subjected to the primary heat-treatment and finally subjected to the secondary heat-treatment is recommendable for the manufacture of the after-burner which has the severe requirements as hereinbefore described.

What is claimed is:

1. A method for making ferrous metal having highly improved resistance to corrosion and oxidization, which comprises dipping a ferrous workpiece in a molten metal bath containing an aluminum alloy, which aluminum alloy contains chromium in an amount of 1 to 10 percent by weight based on the total weight of said aluminum alloy, and having a temperature of from 750° to 930°C, for from 30 to 300 seconds, and heating the resultant ferrous workpiece for at least 30 minutes at an elevated temperature of from 700° to 930°C, thereby forming an intermetallic compound layer uniformly over the surface of said ferrous workpiece, said intermetallic compound layer containing iron and aluminum as its principle components and having a surface portion containing an aluminum-chromium compound.

2. A method as claimed in claim 1, wherein said intermetallic compound layer is 50 to 200 microns in depth.

3. A method as claimed in claim 1, wherein said heating is effected for a period of time not more than 3 hours.

4. A ferrous workpiece prepared according to the method of claim 1, having a surface portion formed with an intermetallic compound layer having relatively high resistance to corrosion and oxidation, said intermetallic compound layer being 50 to 200 microns in depth and containing aluminum and iron as its principle components and having a surface portion containing an aluminum-chromium compound, said aluminum being uniformly distributed in said intermetallic compound layer.

* * * * *